US010120307B2

(12) United States Patent
Okanemasa

(10) Patent No.: US 10,120,307 B2
(45) Date of Patent: Nov. 6, 2018

(54) IMAGE HEATING APPARATUS HAVING A LOCKING MECHANISM THAT LOCKS A GUIDE MEMBER IN A FIRST POSITION AND RELEASES UPON SLIDING MOVEMENT

(71) Applicant: CANON KABUSHIKI KAISHA, Tokyo (JP)

(72) Inventor: Tempei Okanemasa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/682,833

(22) Filed: Aug. 22, 2017

(65) Prior Publication Data

US 2018/0059588 A1 Mar. 1, 2018

(30) Foreign Application Priority Data

Aug. 23, 2016 (JP) ..... 2016-162559

(51) Int. Cl.
*G03G 15/20* (2006.01)
*G03G 21/16* (2006.01)
*G03G 15/00* (2006.01)

(52) U.S. Cl.
CPC ..... *G03G 15/2028* (2013.01); *G03G 15/2035* (2013.01); *G03G 21/1695* (2013.01); *G03G 15/657* (2013.01); *G03G 2215/00413* (2013.01); *G03G 2215/2022* (2013.01)

(58) Field of Classification Search
CPC ..... G03G 15/2028; G03G 15/2035; G03G 15/657; G03G 21/1685; G03G 21/1695; G03G 2215/00413; G03G 2215/2022
USPC ..... 399/122, 316, 322, 400
See application file for complete search history.

(56) References Cited

U.S. PATENT DOCUMENTS 5,732,309 A * 3/1998 Okuno ..... G03G 15/2003 399/322
6,477,350 B1 * 11/2002 Nishimura ..... G03G 15/2025 399/322
6,741,832 B2 5/2004 Tomatsu
2004/0052548 A1 * 3/2004 Shimizu ..... G03G 15/2028 399/122

(Continued)

FOREIGN PATENT DOCUMENTS

JP 2002-278329 A 9/2002
JP 2010-250094 A 11/2010

*Primary Examiner* — Sophia S Chen
(74) *Attorney, Agent, or Firm* — Fitzpatrick, Cella, Harper & Scinto

(57) ABSTRACT

An image heating apparatus for use with an image forming apparatus. The image heating apparatus includes a pair of rotatable members configured to form a nip for heating an image on a recording material, a guide member configured to guide the recording material toward the nip, a supporting mechanism configured to rotatably support the guide member about an axis so that the guide member is movable between a first position at which the guide member guides the recording material and a second position at which the guide member blocks at least a portion of a feeding path of the recording material, and a locking mechanism configured to lock the guide member being in the first position. The locking mechanism releases locking with sliding movement of the guiding member in a direction of the axis.

8 Claims, 12 Drawing Sheets

(56) References Cited

U.S. PATENT DOCUMENTS

2013/0279953 A1* 10/2013 Chikugo ..... G03G 15/657
399/322

* cited by examiner

IMAGE HEATING APPARATUS HAVING A LOCKING MECHANISM THAT LOCKS A GUIDE MEMBER IN A FIRST POSITION AND RELEASES UPON SLIDING MOVEMENT

This application claims the benefit of Japanese Patent Application No. 2016-162559 filed on Aug. 23, 2016, which is hereby incorporated by reference herein in its entirety.

FIELD OF THE INVENTION AND RELATED ART

The present invention relates to an image heating apparatus for heating an image on a recording material. The image heating apparatus is used in an image forming apparatus such as a copying machine, a printer, a facsimile machine, or a multi-function machine having a plurality of functions of these machines.

Conventionally, a fixing device (image heating apparatus) is provided with a guide (guiding) member for guiding the recording material to a nip thereof (Japanese Laid-Open Patent Application (JP-A) 2002-278329 and JP-A 2010-250094).

It has been known that such a guide member is rotated and retracted from a position where the guide member guides the recording material and, then, a maintenance operation is carried out.

SUMMARY OF THE INVENTION

A principal object of the present invention is to provide an image heating apparatus that has been further developed.

According to one aspect, the present invention provides an image heating apparatus for use with an image forming apparatus, comprising a pair of rotatable members configured to form a nip for heating an image on a recording material, a guide member configured to guide the recording material toward the nip, a supporting mechanism configured to rotatably support the guide member about an axis so that the guide member is movable between a first position where the guide member guides the recording material and a second position at which the guide member blocks at least a part of a feeding path of the recording material, and a locking mechanism configured to lock the guide member being in the first position, wherein the locking mechanism releases locking with sliding movement of the guiding member in a direction of the axis.

According to another aspect, the present invention provides an image heating apparatus, comprising a pair of rotatable members configured to form a nip for heating an image on a recording material, a guide member configured to guide the recording material toward the nip, a supporting mechanism configured to rotatably support the guide member about an axis so that the guide member is movable between a first position where the guide member guides the recording material and a second position at which maintenance of the image heating apparatus is carried out, and a locking mechanism configured to lock the guide member being in the first position, wherein the locking mechanism releases locking with sliding movement of the guiding member in a direction of the axis.

According to a further aspect, the present invention provides an image heating apparatus, comprising a pair of rotatable members configured to form a nip for heating an image on a recording material, a guide member configured to guide the recording material toward the nip, a supporting mechanism configured to rotatably support the guide member about an axis so that the guide member is movable between a first position where the guide member guides the recording material and a second position at which the guide member demounts the rotatable members from the image heating apparatus, and a locking mechanism configured to lock movement of the guide member from the first position toward the second position; and a releasing mechanism configured to release locking by the locking mechanism.

Further features of the present invention will become apparent from the following description of exemplary embodiments with reference to the attached drawings.

DESCRIPTION OF EMBODIMENTS

Embodiment (1) Image Forming Apparatus

Figure 9:
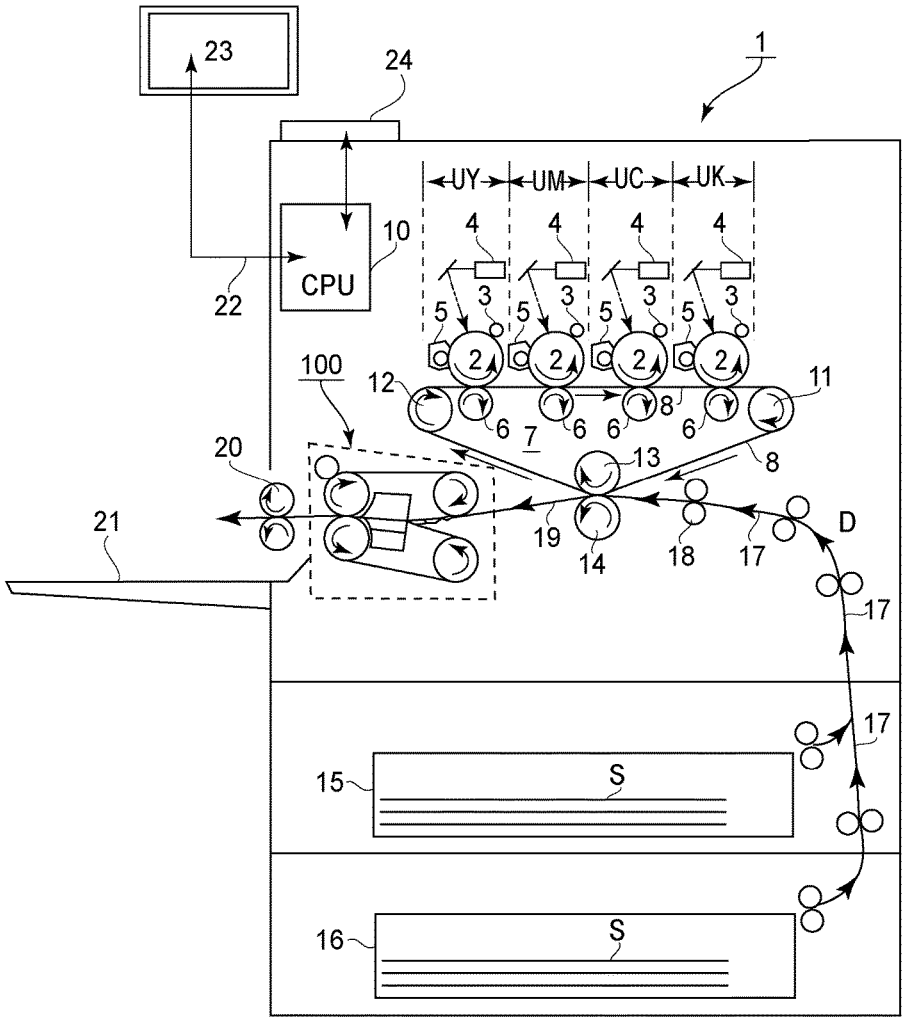
FIG. 9 is a schematic structural view of an image forming apparatus in the embodiment.

FIG. 9 is a schematic structural view of an image forming apparatus 1 in this embodiment. The image forming apparatus 1 is a four-color based full-color electrophotographic printer of an intermediary transfer in-line type, and forms an image, on a recording material S, corresponding to input image data from an external host device 23 such as a personal computer (PC) connected to a controller 10 through an interface 22, and then, prints out the image on the recording material S. A printer operating portion 24 operates the printer 1.

The printer 1 includes four image forming portions UY, UM, UC, and UK, which are electrophotographic image forming mechanisms that are only different in development color and that have the same constitution. Each of the image forming portions includes an electrophotographic photosensitive (member) drum 2 and includes, as process means actable on the drum 2, a charging roller 3, a laser scanner 4, a developing device 5, and a primary transfer roller 6. On the drums 2 of the respective image forming portions UY, UM, UC, and UK, toner images of Y (yellow), M (magenta), C (cyan), and K (black) are formed. An electrophotographic toner image forming process and principle on the drums 2 of the respective image forming portions are well known and, therefore, will be omitted from description.

In a lower side of the respective image forming portions, an intermediary transfer belt unit 7 is provided. This unit 7 includes a flexible endless intermediary transfer belt 8. The belt 8 is extended and stretched among rollers consisting of a driving roller 11, a tension roller 12 and a secondary transfer opposite roller 13. The belt 8 is circulated and moved in the clockwise direction indicated by an arrow at a speed corresponding to the rotational speed of the drums 2. The secondary transfer opposite roller 13 is contacted to the belt 8 toward a secondary transfer roller 14 at predetermined pressure (urging force).

The toner images of Y, M, C, and K formed on the drums 2 of the image forming portions are successively primary-transferred superposedly by the respective primary transfer rollers 6 onto the surface of the belt 8. As a result, an unfixed full-color toner image including the superposed four color toner images is synthetically formed on the belt 8, and is conveyed to a secondary transfer nip that is a contact portion between the belt 8 and the secondary transfer roller 14.

On the other hand, sheets (recording material) S accommodated in a cassette 15 or 16 are separated one by one, and then, the separated recording material S is passed through a conveying (feeding) path 17 to be sent to a registration roller pair 18. The registration roller pair 18 conveys the recording material S to the secondary transfer nip in synchronism with the toner images on the belt 8. At the secondary transfer nip, the toner images for a full-color toner image are collectively secondary-transferred from the belt 8 onto the recording material S.

Then, the recording material S coming out of the secondary transfer nip is separated from the surface of the belt 8 and is passed through a conveying (feeding) path 19 to be guided into a fixing device or apparatus (image heating apparatus) 100. The recording material S is heated and pressed in the fixing apparatus 100, so that the unfixed toner image is fixed as a fixed image. The recording material S coming out of the fixing apparatus 100 is conveyed and discharged, as a full-color image-formed product, onto a discharge tray 21 by a discharging roller pair 20.

(2) Fixing Apparatus 100

Figure 10:
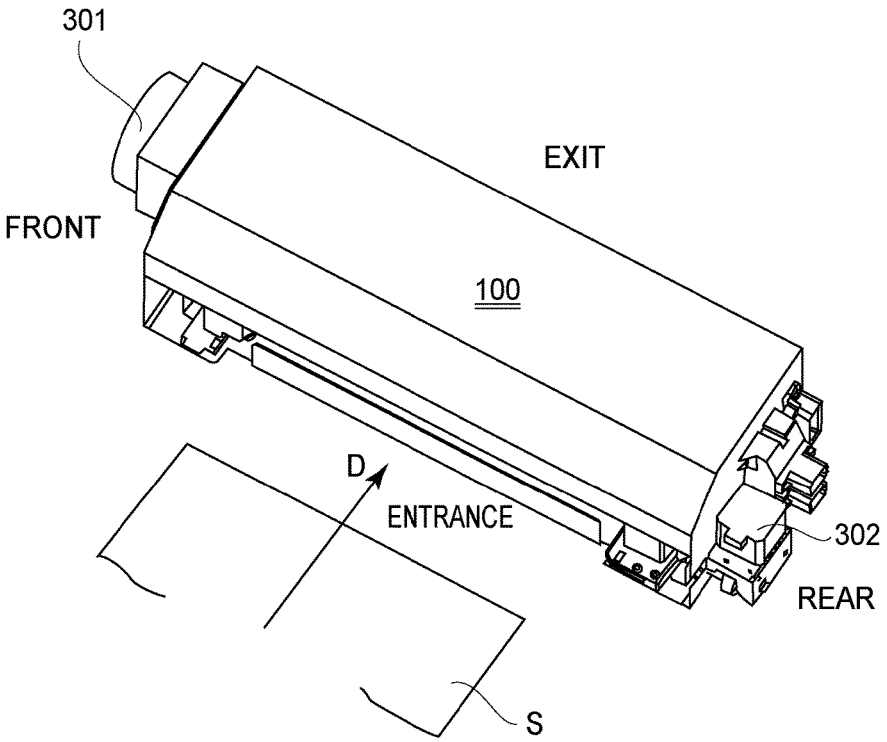
FIG. 10 is a perspective view of the fixing device in the embodiment.
Figure 11:
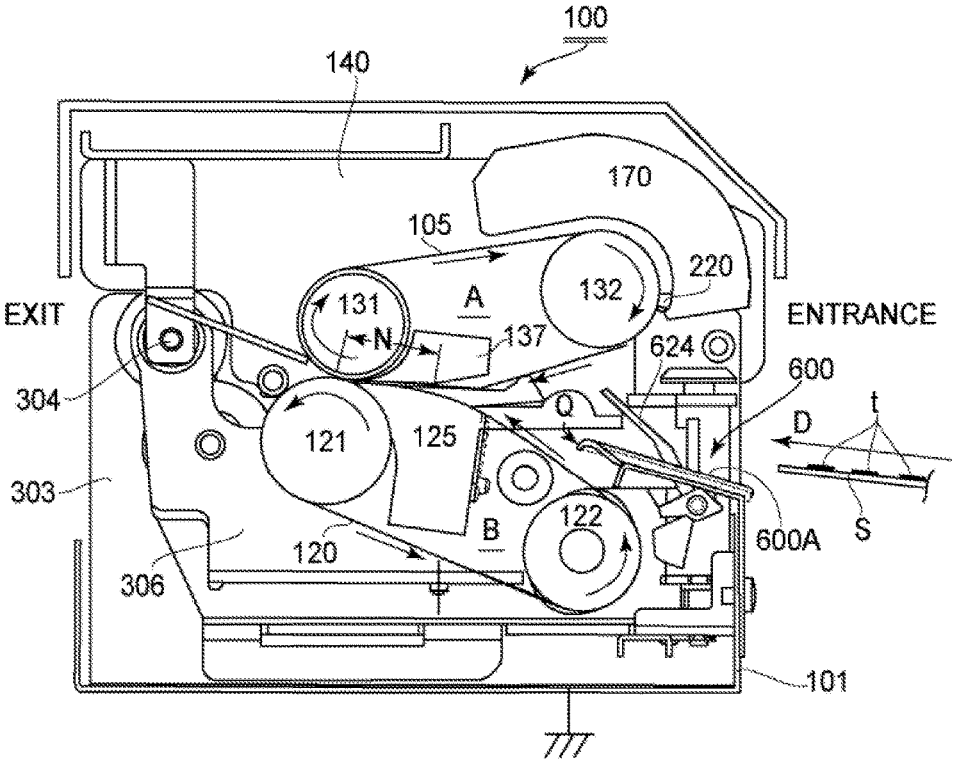
FIG. 11 is a schematic cross-sectional view of the fixing device.

FIG. 10 is a perspective view of an outer appearance of the fixing apparatus 100 in this embodiment. FIG. 11 is a cross-sectional left side view of a principal portion of the image forming apparatus 100, and shows an urged state of a lower(-side) belt assembly B.

Here, with respect to the fixing apparatus 100 or members constituting the fixing apparatus 100, a longitudinal direction (widthwise direction) or a recording material width direction is a direction substantially parallel to a direction perpendicular to a feeding direction D of the recording material S in a recording material feeding path plane. A short(-side) direction is a direction substantially in parallel to the recording material feeding direction D.

Further, with respect to the fixing apparatus 100, a front surface is a surface in a recording material entrance side, and a rear surface is a surface in a recording material exit side. A left surface (side) and a right surface (side) are those when the fixing apparatus 100 is viewed from the front surface. In this embodiment, the right side is a front side, and the left side is a rear side. An upper side and a lower side are those with respect to the direction of gravitation. An upstream side (portion) and a downstream side (portion) are those with respect to the feeding direction D of the recording material S.

The fixing apparatus 100 in this embodiment is an image heating apparatus of a twin belt nip type, an electromagnetic induction heating (IH) type, and an oil-less fixing type. The fixing apparatus 100 includes an upper(-side) belt assembly A, as a heating unit, including a fixing belt 105 and the lower(-side) belt assembly B as a pressing unit, including a pressing belt 120. In this embodiment, the upper belt assembly including the fixing belt 105 and the lower belt assembly including the pressing belt 120 constitutes the fixing apparatus (device) for fixing the toner image on the recording material S at a nip.

Further, the fixing apparatus 100 includes an IH heater (magnetic flux generating means) 170 as a heating means for heating a fixing belt 105 of the upper-side belt assembly A. Further, the fixing apparatus 100 includes a guiding mechanism 600 for guiding the recording material S, conveyed from the image forming portion (secondary transfer roller 14) side, into a fixing nip N thereof. These members will be sequentially described.

(2-1) Upper (-Side) Belt Assembly a and IH Heater 170

The upper (-side) belt assembly A is provided between left and right upper-side plates 140 of a fixing frame (fixing apparatus casing) 101. This assembly A includes a parting layer at its surface and includes a flexible endless fixing belt (heating endless belt) 105 as a rotatable member (rotatable heating member: fixing member) opposing an image-carrying surface of the recording material S. Further, the assembly A includes, as a plurality of belt stretching members for stretching the fixing belt 105, a driving roller (fixing roller) 131, a tension roller 132, and a pad stay 137.

The driving roller 131 is provided between the left and right upper-side plates 140 in the recording material exit side, and left and right shaft portions (not shown) are rotatably supported between the left and right upper-side plates 140 via bearings (not shown).

Each of the outside of the left and right upper-side plates 140, a tension roller supporting arm (not shown) is provided and extended from the driving roller 131 side to the recording material entrance side. The tension roller 132 is provided in the recording material entrance side between the left and right upper-side plates 140, and left and right shaft portions (not shown) thereof are rotatably supported by the above-described left and right supporting arms via bearings (not shown).

The pad stay 137 is a member formed of, e.g., stainless steel (SUS material). This stay 137 is fixed and supported between the left and right upper-side plates 140 at its left and right end portions so that the stay 137 is located inside the fixing belt 105 and closely to the driving roller 131 between the driving roller 131 and the tension roller 132 with a pad receiving surface downward. The fixing belt 105 extended around the driving roller 131, the tension roller 132, and the pad stay 137 is under application of a predetermined tension by movement of the tension roller 132 in a belt tension direction by an urging force of a tension spring (not shown).

In this embodiment, the tension of 200N is applied. A lower-side belt portion of the fixing belt 105 is contacted at its inner surface to the downward pad receiving surface of the pad stay 137.

As the fixing belt 105, any belt may be appropriately selected so long as the belt can be heated by the IH heater 170 and has heat resistance. For example, a belt prepared by coating a 300 μm-thick silicone rubber on a magnetic metal layer, such as a nickel layer or a stainless steel layer, of 75

μm in thickness, 380 mm in width and 200 mm in circumference and then, by coating a PFA tube as a surface layer (parting layer), on the silicone rubber, is used as the fixing belt 105.

The driving roller 131 is, e.g., a roller formed by integrally molding a heat-resistant silicone rubber elastic layer on a surface layer of a solid core metal formed of stainless steel in outer diameter of 18 mm. The driving roller 131 is provided in the recording material exit side in a nip region of the fixing nip N formed between the fixing belt 105 and a pressing belt 120 as a second rotatable member described later, and its elastic layer is elastically distorted in a predetermined amount by press-contact of the pressing roller 121 described later.

The tension roller 132 is, e.g., a hollow roller formed of stainless steel so as to have an outer diameter of 20 mm and an inner diameter of about 18 mm. The tension roller 132 stretches the fixing belt 105 to apply tension to the fixing belt 105.

To a roller shaft of the driving roller 131, a drive input gear (not shown) is coaxially provided and fixed in a left end side. To this gear, input of a driving force from a driving motor 301 (FIG. 6) is made via a drive transmission means (not shown), so that the driving roller 131 is rotationally driven in the clockwise direction indicated an arrow of FIG. 7 at a predetermined speed.

By the rotation of the driving roller 131, the fixing belt 105 is circulated and conveyed in the clockwise direction indicated by the arrow at a speed corresponding to the speed of the driving roller 131. The tension roller 132 is rotated by the circulation conveyance of the fixing belt 105. The inner surface of the lower-side belt portion of the fixing belt 105 slides and moves on the downward pad surface of the pad stay 137. In order to stably convey the recording material S to the fixing nip N described later, the driving force is transmitted with reliability between the frame 105 and the driving roller 131.

The IH heater 170 as the heating means for heating the fixing belt 105 is an induction heating coil unit constituted by an exciting coil, a magnetic core, and a holder for holding these members, and the like. The IH heater 170 is disposed above the upper-side belt assembly A, and is fixed and disposed between the left and right upper-side plates 140 so that it extends from a portion of the upper surface of the fixing belt 105 to a portion of the tension roller 132 and opposes the fixing belt 105 in a non-contact manner with a predetermined gap therebetween.

The exciting coil of the IH heater 170 generates AC magnetic flux by being supplied with an AC current, and the AC magnetic flux is guided by the magnetic core to generate eddy current in the magnetic metal layer of the fixing belt 105 as an induction heat generating member. The eddy current generates Joule heat by specific resistance of the induction heat generating member. The CPU 10 controls the AC current to be supplied to the exciting coil so that a surface temperature of the fixing belt 105 is temperature-controlled at about 140° C. to about 200° C. (target temperature) on the basis of detection temperature information from a thermistor for detecting the surface temperature of the fixing belt 105.

(2-2) Lower-Side Belt Assembly B

The lower-side belt assembly B is provided under the upper-side belt assembly A. This assembly B is assembled with a lower frame (urging frame) 306 rotatably supported in the vertical (up-down) direction about a hinge shaft 304 fixedly provided between left and right lower-side plates 303 in the recording material exit side in the fixing apparatus 100.

This assembly B includes a flexible endless pressing belt (endless belt) 120 as an opposing member (rotatable pressing member: pressing member) for forming the nip N with the fixing belt 105. Further, the assembly B includes, as a plurality of belt stretching members for stretching the pressing belt 120, a pressing roller 121, a tension roller 122, and a pressing pad 125.

The pressing roller 121 is provided so that left and right shaft portions (not shown) thereof are rotatably supported between the left and right side plates of the lower frame 306 via bearings (not shown).

The tension roller 122 is provided so that left and right shaft portions (not shown) thereof are rotatably supported by the left and right side plates of the lower frame 306 via bearings (not shown). Each of the bearings is supported slidably and movably in the belt tension direction relative to the lower frame 306 and is urged by a tension spring (not shown) so as to move in a direction in which the bearing is moved away from the pressing roller 121.

The pressing pad 125 is a member formed with, e.g., a silicone rubber, and left and right end portions thereof are fixed and supported between the left and right side plates of the lower frame 306.

The pressing roller 121 is located in the recording material exit side between the left and right side plates of the lower frame 306. The tension roller 122 is located in the recording material entrance side between the left and right side plates of the lower frame 306. The pressing pad 125 is non-rotationally supported and disposed so that the pad 125 is located inside the pressing belt 120 and closely to the pressing roller 121 between the pressing roller 121 and the tension roller 122 with a pad surface upward.

The pressing belt 120, extended around the pressing roller 121, the tension roller 122, and the pressing pad 125, is under application of a predetermined tension by movement of the tension roller 122 in the belt tension direction by an urging force of a tension spring (not shown). In this embodiment, the tension of 200N is applied. An upper-side portion of the fixing belt 105 is contacted at its inner surface to the upward pad surface of the pressing pad 125.

As the pressing belt 120, any belt may be appropriately selected as long as the belt has heat resistance. For example, a belt prepared by coating a 300 μm-thick silicone rubber on a nickel layer of 50 μm in thickness, 380 mm in width and 200 mm in circumference and then, by coating a PFA tube as a surface layer (parting layer) on the silicone rubber is used as the pressing belt 120. The pressing roller 121 is, e.g., a slid roller formed of stainless steel in outer diameter of 20 mm. The tension roller 122 is, e.g., a hollow roller formed of stainless steel so as to have an outer diameter of 20 mm and an inner diameter of about 18 mm.

In the downstream belt assembly B, the pressing roller 121 and the pressing pad 125 are press-contacted, by a pressing mechanism (not shown), to the pressing belt 120 toward the driving roller 131 and the pad stay 137 of the upper-side belt assembly A via the fixing belt 105.

As a result, between the fixing belt 105 of the upper-side belt assembly A and the pressing belt 120 of the downstream belt assembly B, is the fixing nip N having a predetermined width with respect to the feeding direction of the recording material S.

Here, by the press-contact of the pressing roller 121 to the pressing belt 120 toward the driving roller 131, curvature deformation of about several hundreds of microns is generated on the driving roller 131 in a side opposite from the side where the driving roller 131 opposes the pressing roller 121. This curvature deformation of the driving roller (fixing roller) 131 constitutes a factor of depressure at a longitudinal central portion of the fixing nip N. In order to eliminate this depressure, the driving roller 131 or both of the driving roller 131 and the pressing roller 121 are formed in a crown shape, so that a nip shape provided by the driving roller 131 and the pressing roller 121 is made substantially straight. In this embodiment, the driving roller 131 is formed in a normal crown shape of 300 μm.

(2-3) Fixing Operation and Temperature Control

Figure 8:
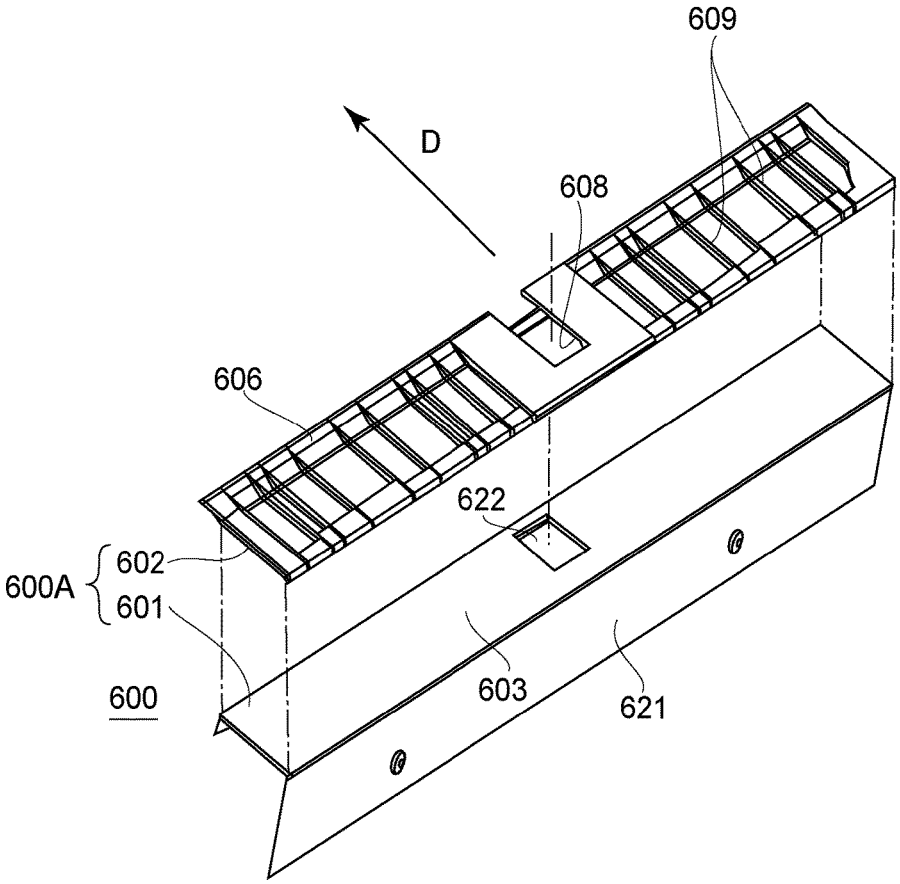
FIG. 8 is an exploded perspective view of the guiding mechanism.
Figure 12:
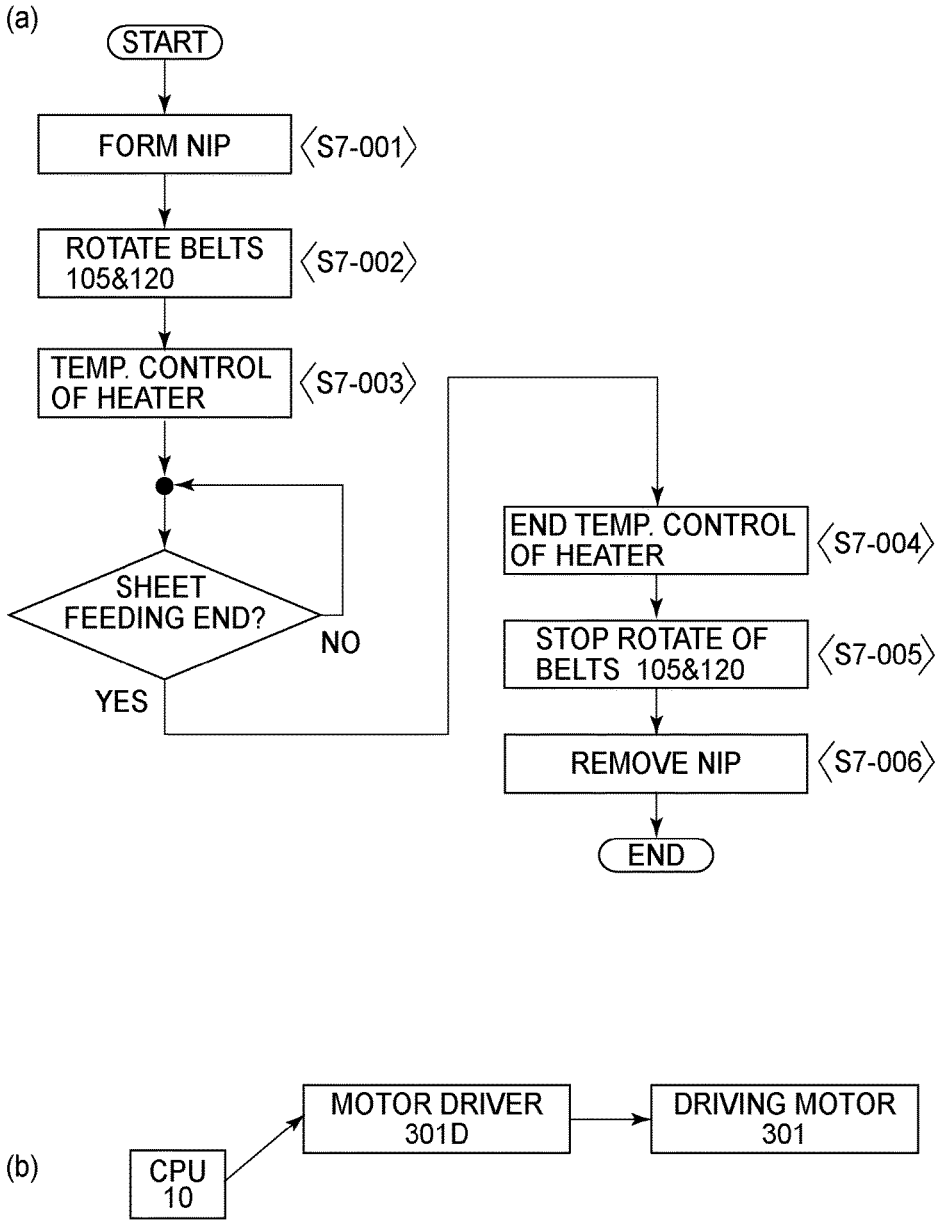
In FIG. 12, (a) is a flowchart of fixing operation control, and (b) is a blocking diagram of a control system.

A fixing operation of the fixing apparatus 100 will be described with reference to a control flow chart of (a) of FIG. 12 and a block diagram of a control system of (b) of FIG. 8. During a stand-by state of the fixing apparatus 100, the lower frame 306 is lowered about the hinge shaft 304. As a result, the lower-side belt assembly B is held at a spaced position where the lower-side belt assembly B is moved downward from the upper-side belt assembly A in a non-contact manner. The drive of the driving motor 301 is stopped. Electrical energy supply to the IH heater 170 is also stopped.

The CPU (controller) 10 starts a predetermined image forming sequence control on the basis of input of a print job start signal. With respect to the fixing apparatus 100, at a predetermined control timing, a pressing motor 302 (FIG. 10) is driven via a motor driver (not shown). As a result, the pressing mechanism performs a pressing operation to raise the lower frame 306 about the hinge shaft 304. As a result, the lower-side belt assembly B is moved to a pressing position of FIG. 11 where the lower-side belt assembly B is press-contacted to the upper-side belt assembly A at a predetermined pressure, so that the fixing nip N having the predetermined width is formed between the fixing belt 105 and the pressing belt 120 <S7-001>.

Next, the CPU 10 drives the driving motor 301 via a motor driver 301D to input the driving force into a drive input gear. As a result, the driving roller 131 of the upper-side belt assembly A is driven as described above to start rotation of the fixing belt 105.

Further, a rotational force of the drive input gear is transmitted to also the pressing belt 120 of the lower-side belt assembly B via a driving gear train (not shown), so that the pressing roller 121 is rotationally driven. With the rotation of the pressing roller 121 and by a frictional force with the rotating fixing belt 105, rotation of the pressing belt 120 is started in the counterclockwise direction indicated by an arrow <S7-002>. The movement directions of the fixing belt 105 and the pressing belt 120 are the same at the fixing nip N and moving speeds thereof are also substantially the same.

Figure 13:
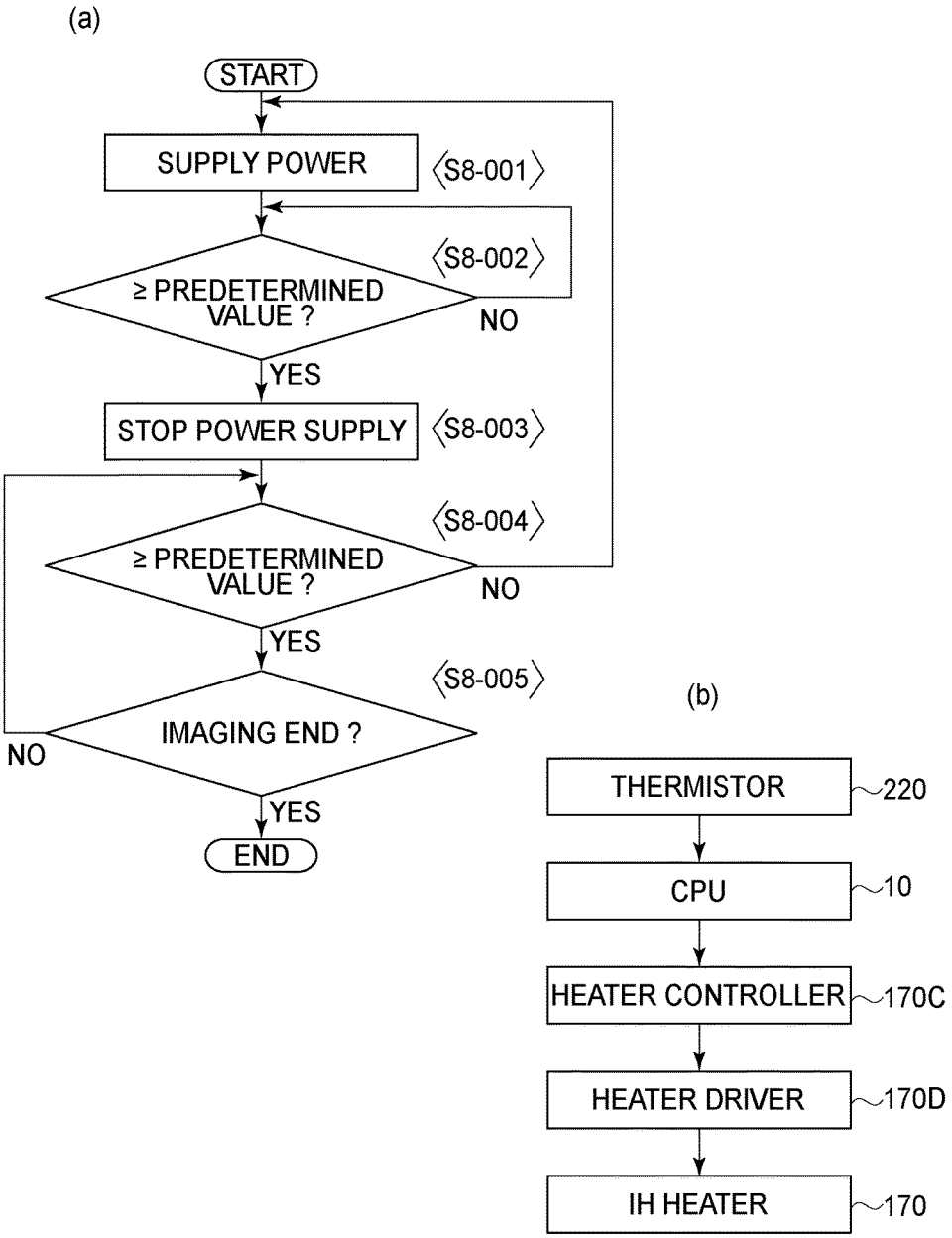
In FIG. 13, (a) is a flowchart of fixing belt temperature control, and (b) is a block diagram of a control system.

Next, the CPU 10 supplies electrical power to the IH heater 170 via a heater controller 170C and a heater driver 170D ((b) of FIG. 13) to heat the rotating fixing belt 105 through electromagnetic induction heating, thus raising the fixing belt temperature to a predetermined target temperature to effect temperature contact. That is, the CPU 10 starts the temperature control such that the temperature of the fixing belt 105 is raised to the target temperature ranging from 140° C. to 200° C. (150° C. in this embodiment) depending on a basis weight or kind of the recording material S (paper) to be introduced into and used in the fixing apparatus 100 and, then, is maintained at the target temperature <S7-003>.

Then, in a state in which the formation of the fixing nip N, the rotation of the fixing belt 105 and the pressing belt 120, and the temperature raising and temperature control of the fixing belt 105 are effected, the recording material S, on which surface the unfixed toner image t is formed, is guided from the image forming portion side into the fixing apparatus 100. The recording material S is guided by a guide (guiding) member 600A of the guiding mechanism 600 provided at a recording material entrance portion of the fixing apparatus 100 to enter the fixing nip N, which is the press-contact portion between the fixing belt 105 and the pressing belt 120. The guiding mechanism 600 is provided with a flag sensor 624 including a photo-interrupter, so that the flag sensor 624 detects passing timing of the recording material S.

The recording material S opposes the fixing belt 105 at its image-carrying surface and opposes the pressing belt 120 at its surface opposite from the image-carrying surface, and, in this state, the recording material S is nipped and conveyed at the fixing nip N. Then, the unfixed toner image t is fixed as fixed image on the recording material surface by heat of the fixing belt 105 and the nip pressure. The recording material S having passed through the fixing nip N is separated from the surface of the fixing belt 105 and comes out of the fixing apparatus 100 from the recording material exit side, and then, is conveyed and discharged onto a discharge tray 21 by a discharging roller pair 20 (FIG. 9).

Then, when the conveyance of the recording material S in the print job of a predetermined single sheet or a plurality of successive sheets is ended, the CPU 10 ends the heating and temperature control of the fixing belt 105 and turns off the power supply to the IH heater 170 <S7-004>. Further, the driving motor 301 is turned off to stop the rotation of the fixing belt 101 and the pressing belt 120 <S7-005>.

Further, the CPU 10 drives the pressing motor 302 via the motor driver to cause the pressing mechanism to perform a pressure-releasing operation, so that the lower frame 306 is lowered and moved about the hinge shaft 304. As a result, the lower-side belt assembly B is moved to the spaced position from the upper-side belt assembly A, thus eliminating the fixing nip N <S7-006>. In this state, the CPU 10 waits for input of a subsequent print job start signal.

With reference to a control flow chart of (a) of FIG. 13 and a black diagram of a control system of (b) of FIG. 13, temperature control of the fixing belt 105 will be described. In the upper-side belt assembly A, a thermistor 220 (FIG. 11), as a temperature detecting member for detecting the surface temperature of the fixing belt 105, is provided. The CPU 10 supplies the electrical power to the IH heater 170 via the heater controller 170C and the heater driver 170D at predetermined control timing on the basis of the input of the print job start signal <S8-001>. The fixing belt 105 is created in temperature through the electromagnetic induction heating by the IH heater 170.

The temperature of the fixing belt 105 is detected by the thermistor 220, and detection temperature information (electrical information on the temperature) is inputted into the CPU 10. The CPU 10 stops the supply of the electrical power to the IH heater 170 when the detection temperature by the thermistor 220 is not less than a predetermined value (target temperature) (<S8-002> and <S8-003>). Thereafter, the CPU 10 resumes, when the detection temperature by the thermistor 220 is lower than the predetermined value <S8-004>, the supply of the electrical power to the IH heater 170 <S8-001>.

By repetition of the above-described steps <S8-001> to <S8-004>, the fixing belt 105 is temperature-controlled and kept at the predetermined target temperature. Then, the above fixing belt temperature control is executed until the print job of the predetermined single sheet or the plurality of successive sheets is ended <S8-005>.

(2-4) Guiding Mechanism 600

Figure 1:
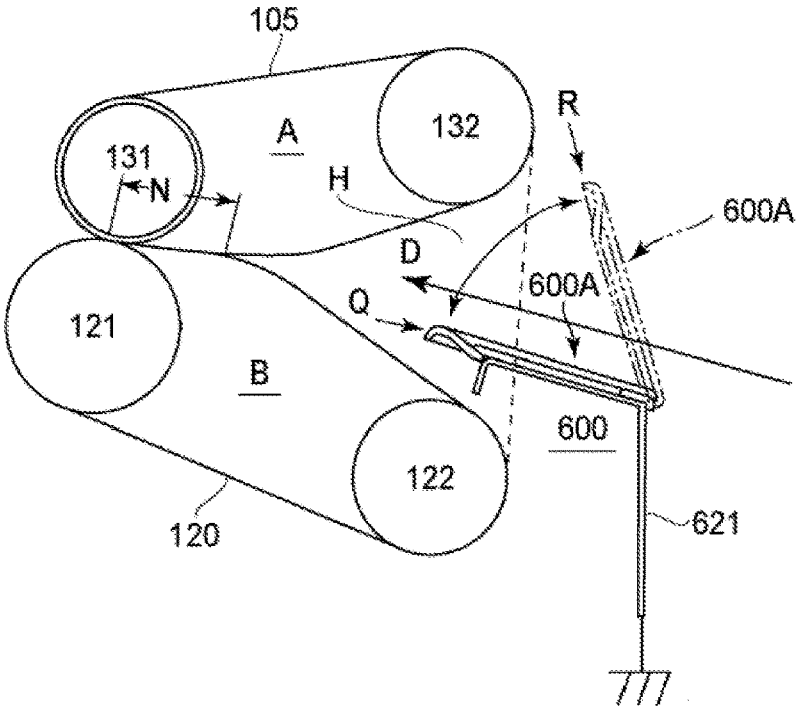
FIG. 1 is a schematic structural view of a principal part of a fixing device of an embodiment.
Figure 2:
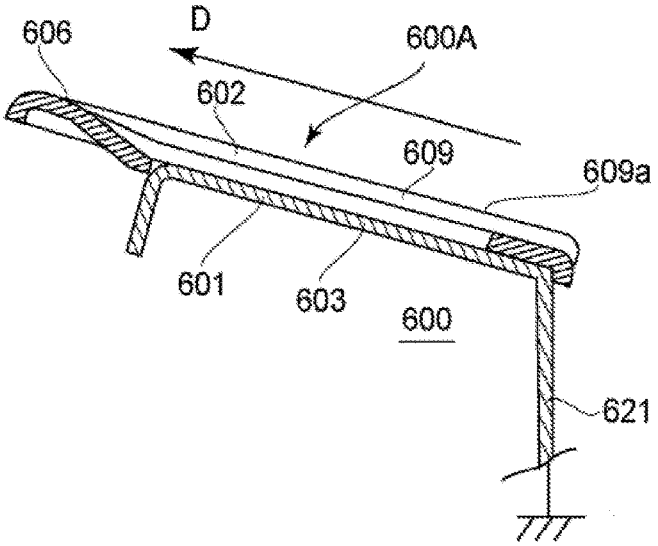
FIG. 2 is a schematic enlarged view of a guide member portion of a guiding mechanism.
Figure 7:
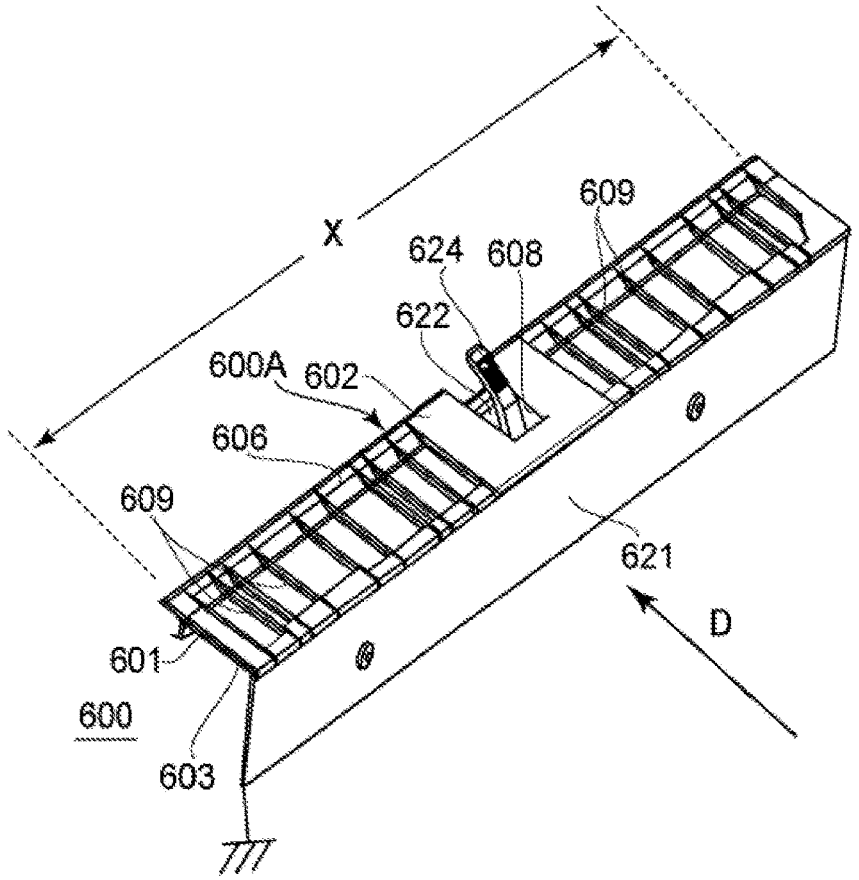
FIG. 7 is a perspective view of the guiding mechanism.

FIG. 1 is a schematic enlarged view of a principal portion of FIG. 11, and FIG. 2 is an enlarged view of the guiding mechanism 600 shown in FIG. 1. FIG. 7 is a perspective view of an outer appearance of the guiding mechanism 600, and FIG. 8 is an exploded perspective view of the guiding mechanism 600.

The guiding mechanism 600 is provided upstream of the fixing nip N, formed by press-contact between the fixing belt 105 and the pressing belt 120, with respect to a recording material feeding direction D. Further, the guiding mechanism 600 has the function of guiding the sheet S, introduced from the image forming portion side into the fixing apparatus 100, to the fixing nip N in a recording material conveyance region (width) X of a maximum width size usable in the fixing apparatus 100.

The guiding mechanism 600 includes the guide member 600A, which receives the recording material S, i.e., contacts the recording material S to be fed and which guides the recording material S toward the nip N. The guide member 600 is movably provided upstream of the lower belt assembly B with respect to the recording material feeding direction D so as to be capable of assuming a first attitude Q indicated by a solid line in FIG. 1 and a second attitude R indicated by a chain double-dashed line in FIG. 1 relative to a supporting member 621 fixedly provided to the fixing frame 101.

The first attitude Q is an attitude capable of guiding the recording material S toward the fixing nip N. In this first attitude Q, a part (downstream side with respect to the recording material feeding direction) of the guide member 600A is positioned in a space H defined by the fixing belt 105 and the pressing belt 120. Further, the guide member 600A is positioned in non-contact with both of the fixing belt 105 and the pressing belt 120 in a side upstream of the fixing nip N, formed by the press contact between the fixing belt 105 and the pressing belt 120, with respect to the recording material feeding direction D.

The guide member 600A in this embodiment is a composite member constituted by an attraction member 601, which is a metal plate and a recording material guide (guiding) member 602, which is an insulating resin member coated on the attraction member 601. The recording material guide member 602 is slidable with the recording material.

The recording material guide member 602 is a plate-like member, which is coated and provided on an attraction surface portion 603 of the attraction member 601, and which extends along a longitudinal direction (left-right direction) of the fixing nip N. Specifically, the recording material guide member 602 is a molded member of an electrically insulating material (non-conductivity: $1\times10^{6}$-$1\times10^{10}$ Ωcm in volume resistivity). In this embodiment, an alloy material of polybutylene terephthalate (PBT) with an ABS resin (PBT+ABS) (volume resistivity: $10^{10}$ Ωcm) is integrally molded.

A recording material sliding portion (slidable with the back surface of the recording material S: the surface of the guiding rib (rib portion) 609) 609*a* of the recording material guide member 602 is formed substantially in parallel to the surface of the attraction surface portion 603 of the attraction member 601.

The recording material sliding portion 609*b* generates movement of the recording material S in the feeding direction D in contact with the back surface of the recording material S.

An opening 608 is located correspondingly to an opening 622 of the attraction surface portion 603 in a state in which the attraction surface portion 603 of the attraction member 601 is covered with the recording material guide member 602. Further, inside the guide member 600A, the flag sensor 624, which is provided on the fixing apparatus frame 101, and which includes the photo-interrupter, is exposed from the inside to outside of the guide member 600A through the openings 622 and 608.

The opening 608 is formed to cover an edge portion of the opening 622 of the attraction surface portion 603 with respect to the recording material S and also so as not to hinder the operation of the flag sensor 624. The flag sensor 624 is tilted by the recording material S moving on the recording material guide member 602, thus detecting passing timing of the recording material S in cooperation with the photo-interrupter.

A free end portion 606 of the recording material guide member 602 is formed in a flat shape (substantially free from a stepped portion) having an R shape at its edge in the fixing nip N side. For that reason, the recording material S attracted by the attraction surface portion 603 of the attraction member 601 can enter the fixing nip N in a state in which the above-described wavy state is eliminated.

Further, the following effect is achieved by extending the attraction surface portion 603 of the attraction member 601 to below the fixing belt 105. The fixing belt 105 as the fixing member is coated with a PFA tube positively charged strongly at its surface, in many cases, and the recording material S tends to be positively charged. Therefore, the recording material S is liable to be electrostatically attracted to the recording material S. Therefore, by extending the attraction surface portion 603 of the attraction member 601 to below the fixing belt 105, the attraction force from the fixing belt 105 is canceled, so that a sheet conveyance property is stabilized.

In this embodiment, in order to demount the lower belt assembly B described later, i.e., in order to block at least a part of the feeding (conveyance) path of the recording material S, the guide member 600A is constituted so as to be rotatable relative to the supporting member 621. A state of the guide member 600A before rotation (first attitude Q: position during introduction of the recording material) is shown in (a) of FIG. 3. A state of the guide member 600A after rotation (second attitude R: position during exchange of the lower belt assembly B) is shown in (b) of FIG. 3. When the guide member 600A is in the second attitude R, a state in which maintenance can be performed by an operator is formed. Specifically, when the guide member 600A is in the second attitude R, a state in which the operator can perform a maintenance operation such that the operator checks whether or not paper piece exists with jamming, or such that the operator cleans a member positioned below the guide member 600A.

Figure 3:
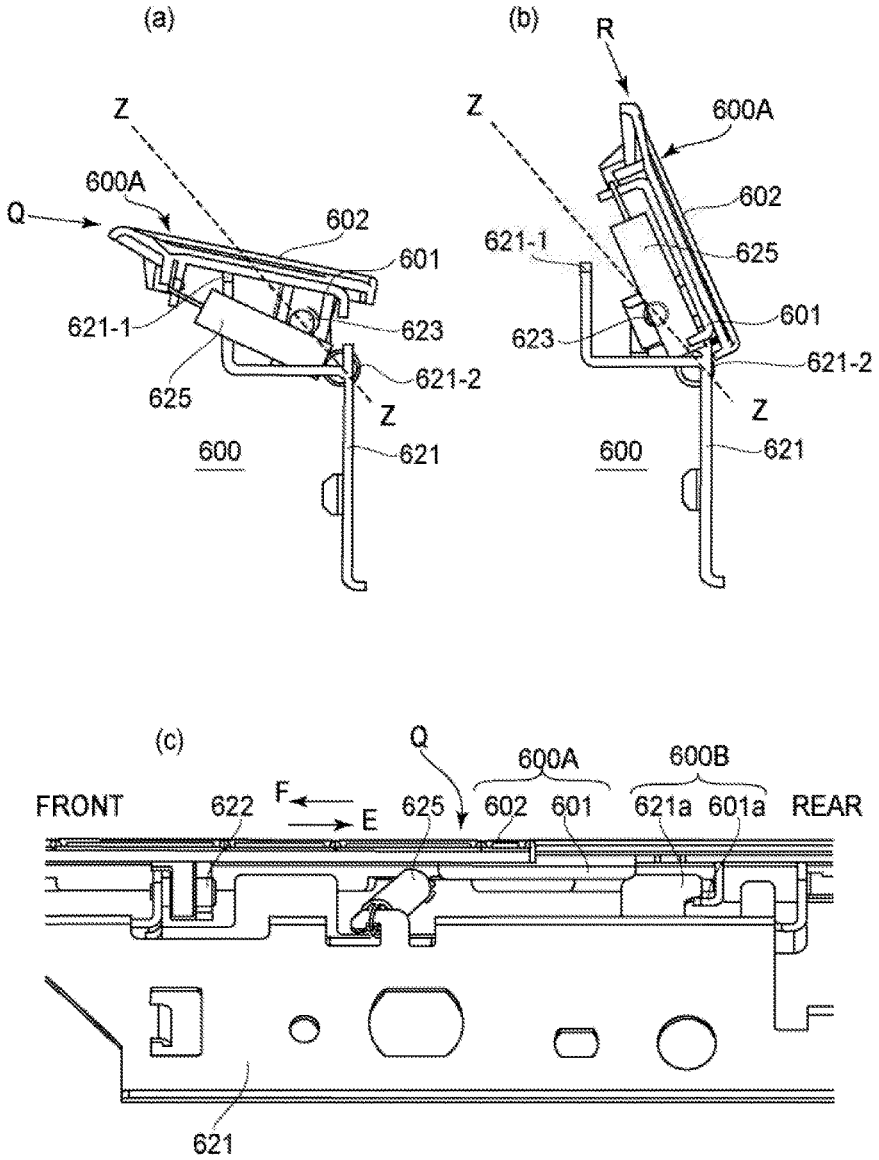
In FIG. 3, (a) to (c) are schematic views for illustrating a rotating mechanism of the guide member and a rotation-preventing constitution.

The first attitude Q of the guide member 600A shown in (a) of FIG. 3 is an attitude such that a part of the guide member 600A is positioned in the space H defined by the fixing belt 105 and the pressing belt 120 as indicated by the solid line in FIG. 1 and such that the guide member 600A is capable of guiding the recording material S toward the fixing nip N.

The second attitude R of the guide member 600A shown in (b) of FIG. 3 is an attitude such that the part of the guide member 600A is retracted from the space H as indicated by the chain double-dashed line in FIG. 1. Accordingly, when the guide member 600A is in this attitude, the guide member

600A blocks almost the feeding path with respect to a widthwise direction perpendicular to the recording material feeding direction D.

The guide member 600A is, as shown in (a) of FIG. 3, received and held (supported) by a first receiving portion (stopper portion) 621-1 of the supporting member 621 in the first attitude Q, which is a predetermined falling state before rotation, with a boundary indicated by a broken line Z-Z, by a toggle action of an urging member 625 of a toggle mechanism.

Further, the guide member 600A is, as shown in (b) of FIG. 3, received and self-supported by a second receiving portion (stopper portion) 621-2 of the supporting member 621 in the second attitude R, which is a predetermined erected state after rotation, with the boundary indicated by the broken line Z-Z, by the toggle action of the urging member 625 of the toggle mechanism.

In this case, a possible problem is such that the recording material S and the guide member 600A contact each other during jam clearance of the recording material S, and the guide member 600A in the first attitude Q of (a) of FIG. 3 is unintentionally rotated and thus, is rotated and self-supported in the second attitude R of (b) of FIG. 3. As a method of solving this problem, in this embodiment, as shown in (c) of FIG. 3, the guiding mechanism 600 is provided with a rotation-preventing constitution (locking mechanism) 600B for the guide member 600A.

The rotation-preventing constitution 600B includes mutual engaging portions 601*a* and 621*a* provided on the recording material attraction member 601 of the guide member 600A and on the supporting member 621, respectively. During the jam clearance, or the like, the engaging portions 601*a* and 621*a* engage with each other, so that the rotation of the guide member 600A is prevented (locked).

In this embodiment, the engaging portions 601*a* and 621*a*, which also function as a releasing mechanism for releasing the locking, are configured so that mutual engagement therebetween is disengaged (released) by sliding the guide member 600A in a rearward direction E perpendicular to the recording material feeding direction D. Therefore, when a service person exchanges the lower belt assembly B, the service person may only be required to disengage the engagement between the engaging portions 601*a* and 621*a* by sliding the guide member 600A in the rearward direction E perpendicular to the recording material feeding direction D and then by rotating the guide member 600A from the first attitude Q to the second attitude R.

The urging member 625 applies a force in a direction of preventing the sliding of the guide member 600A in the rearward direction E so that the guide member 600A unintentionally slides in the rearward direction E, and is not rotated by disengagement between the engaging portions 601*a* and 621*a*. That is, the urging member 625 applies, to the guide member 600A, a component force in a forward direction F opposite to the rearward direction E, which is a direction of disengaging the engaging portions 601*a* and 621*a*. That is, the urging member for urging the guide member 600A is provided with the urging member 625 and an urging direction of the urging member 625 is the direction F of preventing the sliding of the guide member 600A.

Figure 4:
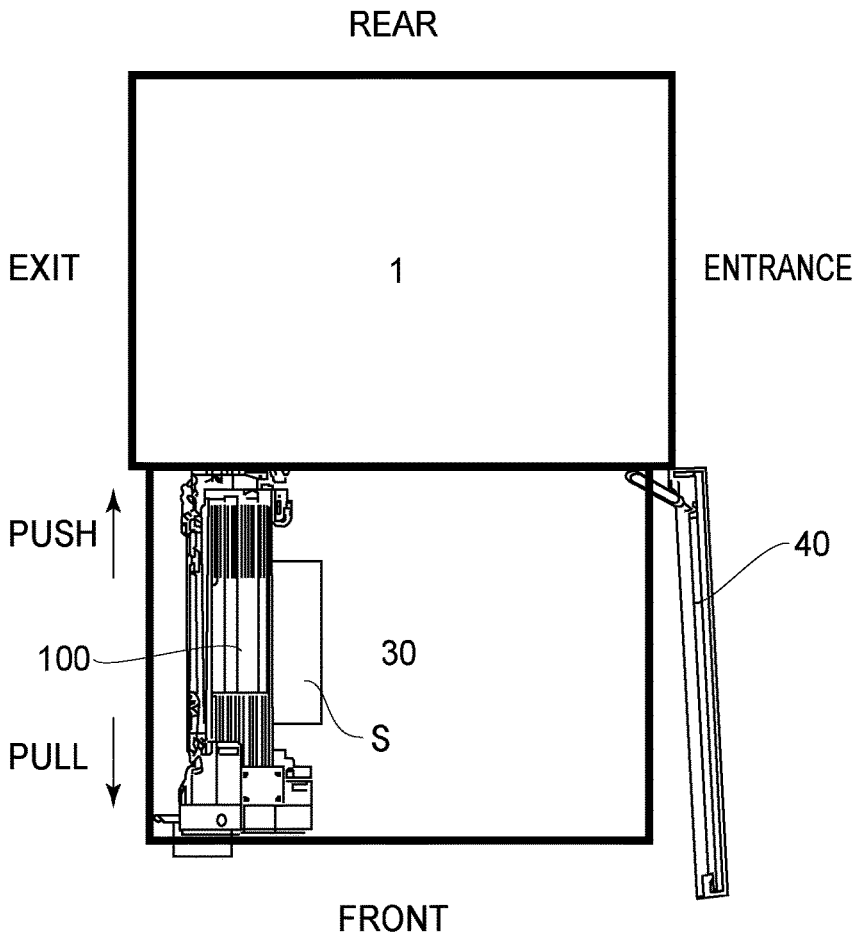
FIG. 4 is an illustration of a manner of clearing a jam generated in the fixing device.

A manner of the clearance of the jam generated in the fixing device (apparatus) 100 will be described. The image forming apparatus 1 includes an openable door 40 capable of opening an inside of an apparatus main assembly. In this embodiment, the image forming apparatus 1 includes the openable door 40 in the front side of the apparatus main assembly. FIG. 4 is a schematic plan view of the image forming apparatus 1 in a state in which the openable door 40 is open.

By opening the openable door 40, the front side of the apparatus main assembly is largely open through an opening. Then, through the opening, a movable fixing device feeding frame 30, on which the fixing device 100 is mounted, can be pulled and moved from the inside of the apparatus main assembly toward an outside of the apparatus main assembly in the front side. The frame 30 is sufficiently pulled and moved in a predetermined manner, so that the fixing device 100 can be sufficiently exposed from a predetermined mounting position to the outside of the apparatus main assembly in a predetermined manner. As a result, the jammed recording material S in the image forming apparatus 1 can be removed.

Figure 5:
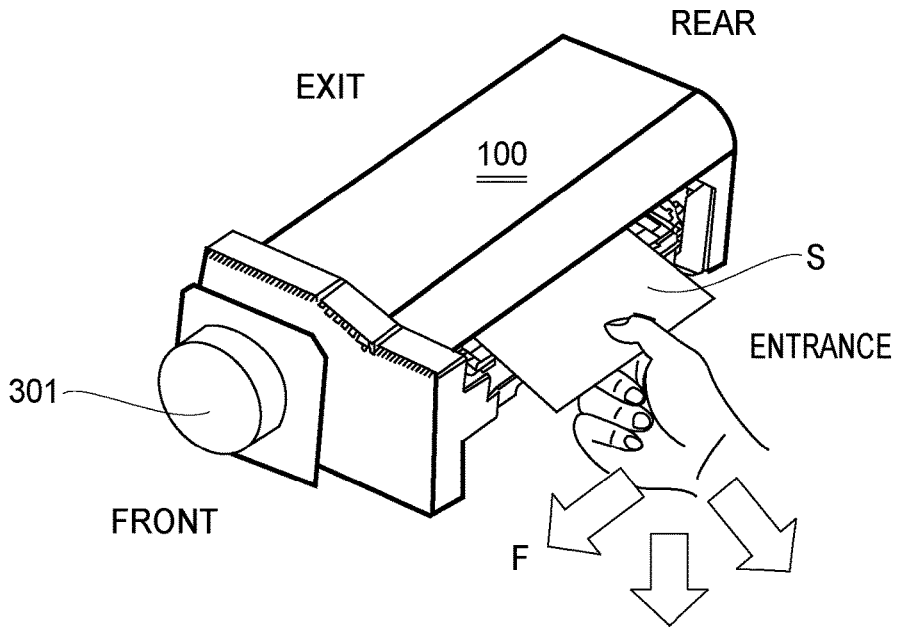
FIG. 5 is an illustration of a jam clearance direction.

When the jam clearance in the neighborhood of the fixing portion is performed by a user, in most cases, a standing position of the user is in the front side of the image forming apparatus 1 in FIG. 4. For that reason, a pulling-out direction of the recording material S jammed in the fixing device 100 exposed to the outside is an entrance side direction or a front side (forward) direction F as shown in FIG. 5.

In this case, the engaging portions 601*a* and 621*a* are provided so as to be engaged with each other when the guide member 600A slides in the front side direction F of (c) of FIG. 3 with the pulling-out of the recording material S. As a result, it is possible to prevent unintended sliding of the guide member 600A due to contact between the recording material S and the guide member 600A during the jam clearance. That is, the rotation-preventing constitution (locking mechanism) 600B for the guide member 600A maintains the locking state when the guide member 600A slides in an opening direction of the openable door 40.

When the jammed recording material S in the fixing device 100 is removed, in a procedure reverse to the above procedure, the frame 30 pulled out to the outside of the apparatus main assembly is pushed and moved sufficiently into the apparatus main assembly. As a result, the fixing device 100 is returned and moved to a predetermined mounting position in the apparatus main assembly. Then, the openable door 40 is closed relative to the apparatus main assembly. As a result, the image forming apparatus 1 is restored to a state in which the image forming operation is capable of being performed.

(2-5) Demounting of Lower(-Side) Belt Assembly B

Figure 6:
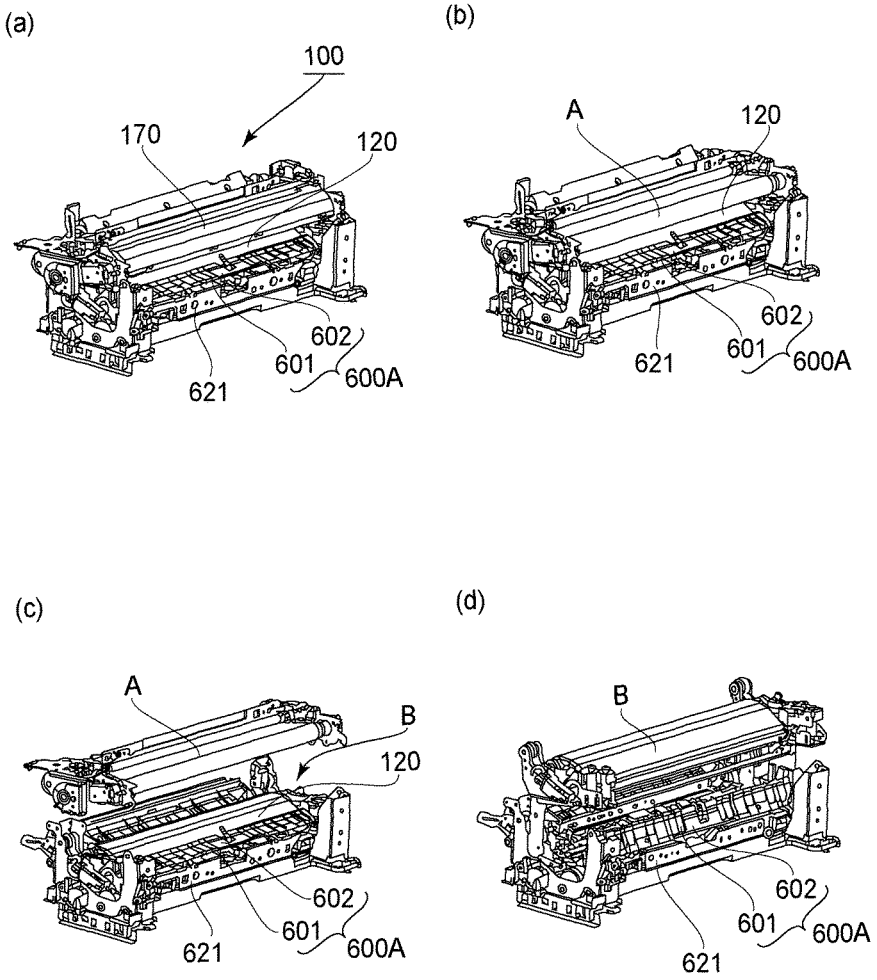
In FIG. 6, (a) to (d) are schematic views for illustrating a demounting procedure of a lower (-side) belt unit (pressing unit).

The lower belt assembly B in the fixing device 100 can be easily demounted in the following manner. A demounting procedure of the lower belt assembly B from the fixing device 100 in this embodiment is shown in FIG. 6. This operation is performed in a state in which the frame 30 is sufficiently pulled out in a predetermined manner and thus the fixing device 100 is sufficiently exposed to the outside of the apparatus main assembly in a predetermined manner.

First, as shown in (a) of FIG. 6, an IH heater 170 is demounted from between left and right upper-side plates 140 of the fixing frame 101, so that the fixing device 100 is put in a state of (b) of FIG. 6. Then, as shown in (c) of FIG. 6, the upper belt assembly A is demounted from between the left and right upper-side plates 140 of the fixing frame 101.

Here, in the state of (c) of FIG. 6, when also the lower belt assembly B is intended to be demounted, there is a liability that the lower belt assembly B contacts the guide member 600A held in the first attitude Q as shown in (a) of FIG. 3. Therefore, the guide member 600A held in the first attitude Q is slid in the rear end direction E ((c) of FIG. 3) in the above-described manner and, thus, the engagement between the engaging portions 601*a* and 621*a* is eliminated (released), and the guide member 600A is rotated to the second attitude R as shown in (b) of FIG. 3. As a result, the lower belt assembly B can be demounted from between left and right lower-side plates 306 of the fixing frame 101 without being contacted to the guide member 600A.

Then, a new lower belt assembly B is mounted to between the left and right lower-side plates 306 of the fixing frame 101. Also, in this case, the guide member 600A is rotated to the second attitude R, and therefore, the lower belt assembly B can be mounted without being contacted to the guide member 600A.

Then, the guide member 600A rotated to the second attitude R is rotated and returned to the first attitude Q. Thereafter, the upper belt assembly A is mounted to between the left and right upper-side plates 140 of the fixing frame 140 and the IH heater 170 is mounted, so that the exchange operation of the lower belt assembly B is completed.

Thereafter, the frame 30 pulled out to the outside of the apparatus main assembly is moved and pressed sufficiently into the apparatus main assembly. As a result, the fixing device 100 is moved and returned to the predetermined mounting position of the inside of the apparatus main assembly. Then, the openable door 40 is closed relative to the apparatus main assembly. As a result, the image forming apparatus 1 is restored to the state in which the image forming operation can be performed.

OTHER EMBODIMENTS (1) In the fixing device in the above-described embodiment, the constitution in which the guide member 600A is provided rotatably about the rotation shaft (axis) 623 relative to the supporting member 621 so as to assume the first attitude Q and the second attitude R was employed, but the present invention is not limited thereto. For example, a constitution in which the guide member 600A is provided slidably in the recording material feeding direction D relative to the supporting member 621, so as to assume the first attitude Q and the second attitude R, can be employed.

(2) In the fixing device 100 in the above-described embodiment, the first and second rotatable members for nipping and feeding the recording material S in the nip N formed therebetween are both endless belts 105 and 120, but the present invention is not limited thereto. It is also possible to employ a device constitution in which both of the first and second rotatable members are rollers and a device constitution in which one of the first and second rotatable members is the endless belt and the other is the roller.

(3) In the above-described embodiment, as the image heating apparatus, the fixing device (apparatus) for heating and fixing the unfixed transfer image formed on the recording material was described as an example, but the present invention is not limited thereto. The present invention is also applicable to a device (apparatus) of increasing gloss (glossiness) of an image by re-heating a toner image fixed or temporarily fixed on the recording material (glossiness improving device (apparatus)).

(4) The image forming portion of the image forming apparatus is not limited to that of the electrophotographic type, but may also be those of an electrostatic recording type or a magnetic recording type. Further, the transfer type is not limited, but it is also possible to employ a constitution in which the unfixed image is directly formed on the recording material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image heating apparatus for use with an image forming apparatus, the image heating apparatus comprising:
- a pair of rotatable members configured to form a nip for heating an image on a recording material;
- a guide member configured to guide the recording material toward the nip;
- a supporting mechanism configured to rotatably support said guide member about an axis so that said guide member is movable between a first position at which said guide member guides the recording material and a second position at which said guide member blocks at least a portion of a feeding path of the recording material; and
- a locking mechanism configured to lock said guide member being in the first position, wherein said locking mechanism releases locking with sliding movement of said guiding member in a direction of the axis.

2. An image heating apparatus according to claim 1, wherein a direction of the sliding movement of said guide member is a direction from a front side toward a rear side of the image forming apparatus.

3. An image heating apparatus according to claim 2, further comprising an urging portion configured to urge said guide member in a direction opposite to the direction of the sliding movement of said guide member.

4. An image heating apparatus according to claim 1, further comprising a first stopper portion configured to stop rotation of said guide member in the first position and a second stop per portion configured to stop the rotation of said guide member in the second position.

5. An image heating apparatus according to claim 4, further comprising a toggle mechanism configured to impart a force for pressing said guide member against said first stopper or said second stopper.

6. An image heating apparatus according to claim 5, wherein said locking mechanism does not lock said guide member in the second position.

7. An image heating apparatus comprising:
- a pair of rotatable members configured to form a nip for heating an image on a recording material;
- a guide member configured to guide the recording material toward the nip;
- a supporting mechanism configured to rotatably support said guide member about an axis so that said guide member is movable between a first position at which said guide member guides the recording material and a second position at which maintenance of said image heating apparatus is carried out; and
- a locking mechanism configured to lock said guide member being in the first position, wherein said locking mechanism releases locking with sliding movement of said guiding member in a direction of the axis.

8. An image heating apparatus comprising:
- a pair of rotatable members configured to form a nip for heating an image on a recording material;
- a guide member configured to guide the recording material toward the nip;
- a supporting mechanism configured to rotatably support said guide member about an axis so that said guide member is movable between a first position at which said guide member guides the recording material and a second position at which said guide member said rotatable members from said image heating apparatus; and a locking mechanism configured to lock movement of said guide member from the first position toward the second position, wherein said locking mechanism releases locking with sliding movement of said guide member in a direction of the axis.

* * * * *